US007096979B2

(12) United States Patent
Haci et al.

(10) Patent No.: US 7,096,979 B2
(45) Date of Patent: Aug. 29, 2006

(54) CONTINUOUS ON-BOTTOM DIRECTIONAL DRILLING METHOD AND SYSTEM

(75) Inventors: Marc Haci, Houston, TX (US); Eric E. Maidla, Sugar Land, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 218 days.

(21) Appl. No.: 10/612,277

(22) Filed: Jul. 1, 2003

(65) Prior Publication Data

US 2004/0222023 A1 Nov. 11, 2004

Related U.S. Application Data

(60) Provisional application No. 60/469,293, filed on May 10, 2003.

(51) Int. Cl.
*E21B 7/04* (2006.01)

(52) U.S. Cl. ..... 175/61; 175/26; 175/45; 175/73; 175/103

(58) Field of Classification Search ..... 175/19, 175/26, 45, 48, 57, 61, 73–75, 113, 114, 195, 175/202, 256
See application file for complete search history.

(56) References Cited

U.S. PATENT DOCUMENTS 6,494,272 B1 * 12/2002 Eppink et al. ..... 175/57
6,848,518 B1 * 2/2005 Chen et al. ..... 175/61

* cited by examiner

*Primary Examiner*—Zakiya W. Bates
(74) *Attorney, Agent, or Firm*—Jonathan E. Jobe; Richard A. Fagin

(57) ABSTRACT

A method of and system for directional drilling alternate between rotary drilling and sliding drilling with the bit remaining in continuous contact with the bottom of the bore hole.

68 Claims, 5 Drawing Sheets

CONTINUOUS ON-BOTTOM DIRECTIONAL DRILLING METHOD AND SYSTEM

CROSS REFERENCE TO RELATED APPLICATIONS

Priority is claimed from U.S. Provisional Application No. 60/469,293 filed on May 10, 2003.

FIELD OF THE INVENTION

The present invention relates generally to the field of oil and gas well drilling. More particularly, the present invention relates to a method of and system for directional drilling with a steerable drilling motor, that includes alternating between rotary and sliding drilling while the bit remains continuously in contact with the bottom of the bore hole.

BACKGROUND OF THE INVENTION

It is very expensive to drill bore holes in the earth such as those made in connection with oil and gas wells. Oil and gas bearing formations are typically located thousands of feet below the surface of the earth. Accordingly, thousands of feet of rock must be penetrated in order to reach the producing formations. Additionally, many wells are drilled directionally, wherein the target formations may be located thousands of feet laterally away from the well's surface location. Thus, in directional drilling, not only must the depth be penetrated but the lateral distance of rock must also be penetrated.

The cost of drilling a well is primarily time dependent. Accordingly, the faster the desired penetration location, both in terms of depth and lateral location, is achieved, the lower the cost in completing the well. While many operations are required to drill and complete a well, perhaps the most important is the actual drilling of the bore hole. Drilling directionally to a target formation located a great distance from the surface location of the bore hole is inherently more time consuming than drilling vertically to a target formation directly below the surface location of the bore hole.

There are a number of directional drilling techniques known in the art for drilling a bore hole along a selected trajectory to a target formation from a surface location. A widely used directional drilling technique includes using an hydraulically powered drilling motor in a drill string to turn a drill bit. The hydraulic power to operate the motor is supplied by flow of drilling fluid through the drill string from the earth's surface. The motor housing includes a slight bend, typically ½ to 3 degrees along its axis in order to change the trajectory of the bore hole. One such motor is known as a "steerable motor." A steerable motor can control the trajectory of a bore hole by drilling in one of two modes.

The first mode, called rotary drilling mode, is used to maintain the trajectory of the bore hole at the current azimuth and inclination. In rotary drilling mode, the drill string is rotated from the earth's surface, such that the steerable motor rotates with the drill string.

The other mode is used to adjust the trajectory and is called "sliding drilling" or "slide drilling." During sliding drilling, the drill string is not rotated. The direction of drilling (or the change in the bore hole trajectory) is determined by the tool face angle of the drilling motor. Tool face angle is determined by the direction to which the bend in the motor housing is oriented. The tool face can be adjusted from the earth's surface by turning the drill string and obtaining information on the tool face orientation by measurements made in the bore hole by a steering tool or similar directional measuring instrument. Tool face angle information is typically conveyed from the directional measuring instrument to the earth's surface using relatively low bandwidth drilling mud pressure modulation ("mud pulse") signaling. The driller (drilling rig operator) attempts to maintain the proper tool face angle by applying torque or drill string angle corrections to the drill string from the earth's surface using a rotary table or top drive on the drilling rig.

Several difficulties in directional drilling are caused by the fact that a substantial length of the drill string is in frictional contact with and is supported by the bore hole. Because the drill string is not rotating in sliding drilling mode, it is difficult to overcome the friction. The difficulty in overcoming the friction makes it difficult for the driller to apply sufficient weight (axial force) to the bit to achieve an optimal rate of penetration. The drill string also typically exhibits stick/slip motion such that when a sufficient amount of weight is applied to overcome the friction, the weight on bit tends to overshoot the optimum magnitude, and in some cases the applied weight to the bit may be such that the torque capacity of the drilling motor is exceeded. Exceeding the torque capacity of the drilling motor may cause the motor to stall. Motor stalling is undesirable because the drilling motor cannot drill when stalled, and stilling lessens the life of the drilling motor.

Additionally, the reactive torque that would be transmitted from the bit to the surface through the drill string, if the hole were vertical, is absorbed by the friction between the drill string and the borehole. Thus, during drilling, there is substantially no reactive torque experienced at the surface. Moreover, when the driller applies drill string angle corrections at the surface in an attempt to correct the tool face angle, a substantial amount of the angular change is absorbed by friction without changing the tool face angle. Even more difficult is when the torque applied from the surface overcomes the friction in stick/Slip fashion. When enough angular correction is applied to overcome the friction, the tool face angle may overshoot its target, thereby requiring the driller to apply a reverse angular correction. These difficulties make course correction by sliding drilling time consuming and expensive as a consequence.

It is known in the art that the frictional engagement between the drill string and the borehole can be reduced by rotating the drill string back and forth ("rocking") between a first angle and a second angle measured at the earth's surface. See, for example, U.S. Pat. No. 6,503,48 issued to Richarson. By rocking the string, the stick/slip friction is reduced, thereby making it easier for the driller to control the weight on bit and make appropriate tool face angle corrections. A limitation to using surface angle alone as a basis for rocking the drill string is that it does not account for the friction between the wall of the bore hole and the drill string. Rocking to a selected angle may either not reduce the friction sufficiently to be useful, or may exceed the friction torque of the drill string in the bore hole, thus unintentionally changing the tool face angle of the drilling motor. Further, rocking to angle alone may result in motor stalling if too much weight is suddenly transferred to the bit as friction is overcome.

Another difficulty in directional drilling is controlling the orientation of the drilling motor during sliding drilling. Tool face angle information is measured downhole by a steering tool and displayed to the directional driller. The driller attempts to maintain the proper face angle by manually applying torque corrections to the drill string. However, the driller typically over- or under-corrects. The over- or under-correction results in substantial back and forth wandering of the tool face angle, which increases the distance that must be drilled in order to reach the target formation. Back and forth wandering also increases the risk of stuck pipe and makes the running and setting of casing more difficult.

A further difficulty in directional drilling is in the transitions back and forth between sliding drilling and rotary drilling. Substantial reactive torque is stored in the drill string during both sliding and rotating drilling in the form of "wraps" or twists of pipe. During drilling, the drill string may be twisted several revolutions between the surface and the drilling motor. Currently, in transitioning between sliding drilling and rotary drilling (and vice versa), the bit is lifted off the bottom, which releases torque stored in the drill string. When drilling resumes, the bit is lowered to the bottom and the reactive torque of the steerable motor must be put back into the drill string before bit rotation resumes to a degree such that earth penetration is effective. Moreover, when sliding, drilling commences, the driller has little control over the tool face angle until the torque applied to the drill string stabilizes at about the amount of reactive torque in the drill string, which adds to the difficulties inherent in controlling direction. As a result, slide drilling has proven to be inefficient and time consuming.

SUMMARY OF THE INVENTION

The present invention provides a method of and system for directional drilling of a bore hole. Briefly stated, the method and system of the present invention alternates between rotary drilling and sliding drilling with the bit remaining in substantially continuous contact with the bottom of the bore hole. During rotary drilling, the drill string is rotated at a first rotational speed and the drill string and drilling motor are advanced axially along the well bore. When the driller (drilling rig operator) desires to switch to sliding drilling, the driller slows the rotation of the, drill string to a second rate of rotational speed. In one embodiment, the slowing rotation of the drill string can be performed while maintaining optimum weight on bit, as indicated by drilling fluid pressure. When the tool face angle of the drilling motor is at a selected angle with respect to the target tool face angle, the driller commences sliding drilling by stopping rotation of the drill string.

In one embodiment, the driller commences sliding drilling by starting a cyclical rocking routine that rotates the drill string back and forth between selected left-hand and right-hand torque magnitudes. The left-hand and right-hand torque magnitudes are selected so as not the rotate the drilling motor. When the tool face angle of the drilling motor stabilizes, the driller maintains the tool face angle at the target tool face angle. If the tool face angle is relatively near the target, the driller can change the tool face angle by varying weight on bit, as indicated by pressure of the drilling fluid. If the tool face angle is more than a selected angular displacement from the target, the driller increases one of the left-hand or right-hand torque magnitudes by a selected amount for at least one rocking cycle, which "bumps" the drilling motor in the corresponding direction. When the driller desires to switch back to rotary drilling, the driller temporarily stops advancing the drill string and, in one embodiment, stops the rocking cycle. Stopping advancing the drill string allows a portion of the weight on bit (axial compression of the drill pipe) to be "drilled off." When an appropriate amount of weight has been drilled off, as can be indicated by a change in tool face angle, the driller begins rotating and advancing the drill string.

In an alternative embodiment, the drill string is not rocked during sliding drilling. In the alternative embodiment, when the tool face angle is at the selected angle with respect to the target, the driller stops rotating and advancing the drill string. When the tool face angle is near the target, the driller starts advancing the drill string again. When the tool face angle of the drilling motor stabilizes, the driller maintains the tool face angle at the target tool face angle. Again, if the tool face angle is relatively near the target, the driller can change the tool face angle by varying weight on bit, as indicated by drilling fluid pressure. Similarly, if the tool face angle is more angularly displaced from the target, the driller increases one of the left or right torque limits by a selected amount for one rocking cycle, which "bumps" the drilling motor in the corresponding direction. When the driller desires to switch back to rotary drilling, the temporarily stops advancing the drill string to allow a portion of the weight on bit to be drilled off. When an appropriate amount of weight has been drilled off, as can be indicated by a change in tool face angle, the driller begins rotating and advancing the drill string.

DESCRIPTION OF THE PREFERRED EMBODIMENTS

Figure 1:
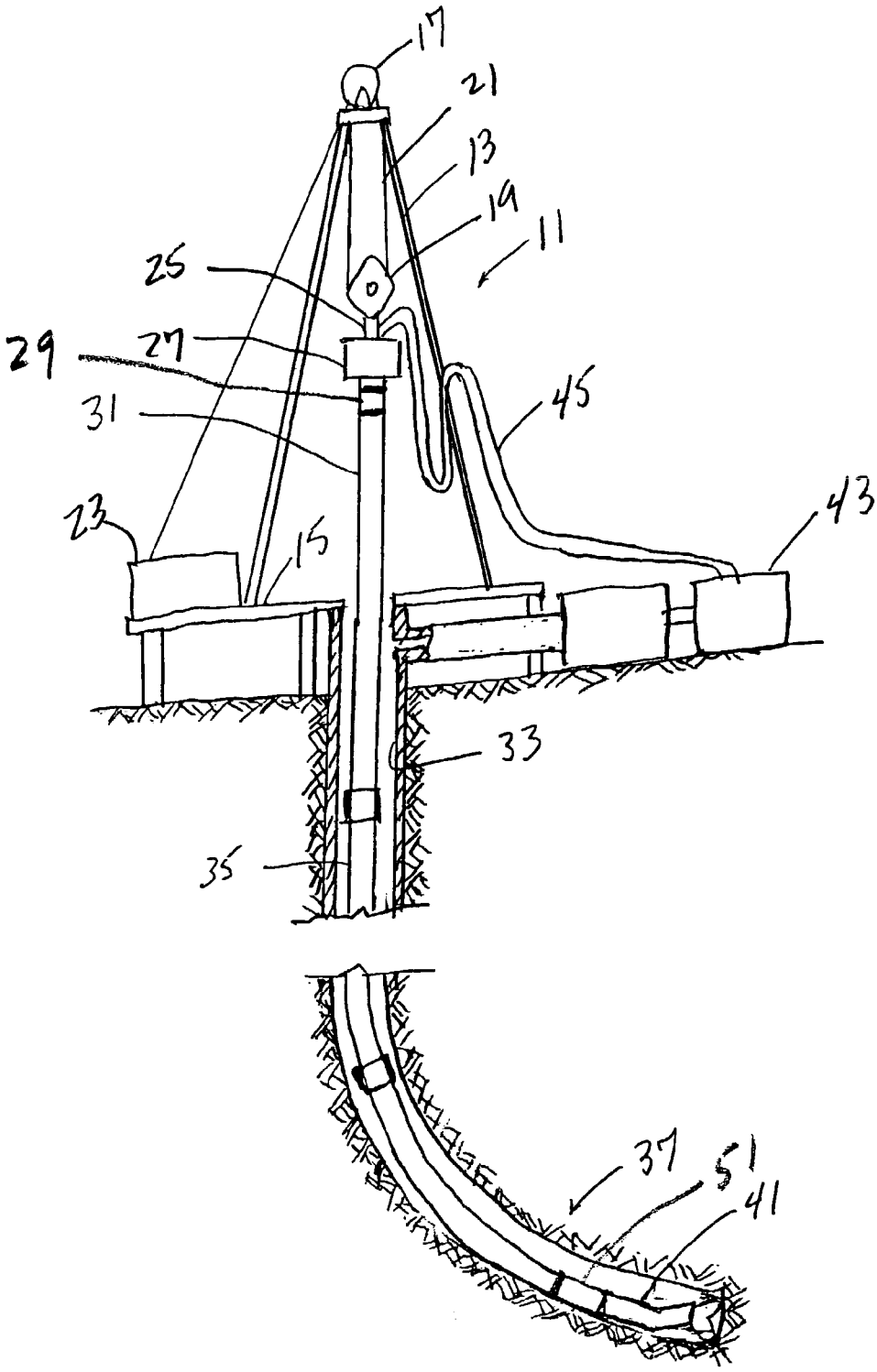
FIG. 1 is a pictorial view of a directional drilling system.

Referring to FIG. 1, a drilling rig is designated generally by reference numeral 11. The rig 11 in FIG. 1 is depicted as a "land" rig. However, as will be apparent to those skilled in the art, the method and system of the present invention will find equal application to water-borne rigs, such as jack-up rigs, semisubmersible rigs, drill ships, and the like.

The rig 11 includes a derrick 13 that is supported on the ground above a rig floor 15. The rig 11 includes lifting gear, which includes a crown block 17 mounted to the derrick 13 and a traveling block 19. The crown block 17 and the traveling block 19 are interconnected by a cable 21 that is driven by a drawworks 23 to control the upward and downward movement of the traveling block 19. The traveling block 19 carries a hook 25 from which is suspended a top drive 27. The top drive 27 rotatably supports a drill string, designated generally by the numeral 35, in a well bore 33. The top drive 27 can be operated to rotate drill string 31 in either direction.

According to one embodiment of the present invention, the drill string 35 is coupled to the top drive 27 through an instrumented top sub 29. As will be discussed in detail hereinafter, the instrumented top sub 29 includes sensors (not shown separately) that provide measurements of drill string torque that are used according to the present invention.

Other embodiments may include sensors for measuring a parameter related to torque. One example of such a param eter includes electric current drawn by an electric motor (not shown) that operates the top drive 27, for electric top drives. Another example of such a parameter is hydraulic pressure applied to an hydraulic motor (not shown) used to operate the top drive 27 for hydraulic top drives. Other parameters which may be measured, and sensors therefor, will be apparent to those skilled in the art.

The drill string 35 includes a plurality of interconnected sections of drill pipe (not shown separately), a bottom hole assembly (BHA) 37, which may include stabilizers, drill collars, and a suite of measurement while drilling (MWD) instruments, including a directional sensor 51. As will be explained in detail hereinafter, the directional sensor 51 provides, among other measurements, tool face angle measurements that can be used according to the present invention, as well as bore hole azimuth and inclination measurements.

A steerable drilling motor 41 is connected near the bottom of the BHA 37. As is well known to those skilled in the art, the tool face angle of the drilling motor 41 is used to correct or adjust the azimuth and/or inclination of the bore hole 33 during sliding drilling. Drilling fluid is delivered to the interior of the drill string 35 by mud pumps 43 through a mud hose 45. During rotary drilling, the drill string 35 is rotated within the bore hole 33 by the top drive 27. As is well known to those skilled in the art, the top drive 27 is slidingly mounted on parallel vertically extending rails (not shown) to resist rotation as torque is applied to the drill string 35. During sliding drilling, the drill string 35 is held rotationally in place by top drive 27 while the drill bit 40 is rotated by the drilling motor 41. The motor 41 is ultimately supplied with drilling fluid by the mud pumps 43.

The rig operator (driller) can operate the top drive 27 to change the tool face angle of the drilling motor 41 by rotating the entire drill string 35. Although a top drive rig is illustrated in FIG. 1, those skilled in the art will recognize that the present invention may also be used in connection with systems in which a rotary table and kelly (neither shown in the Figures) are used to apply torque to the drill string. The cuttings produced as the bit 40 drills into the earth are carried out of bore hole 33 by the drilling mud supplied by the mud pumps 43.

The discharge side of the mud pumps 43 includes a pressure sensor 63 (FIG. 2) operatively coupled thereto. The pressure sensor 63 makes measurements corresponding to the pressure inside the drill string 35. The actual location of the pressure sensor 63 is not intended to limit the scope of the invention. It is only necessary, for certain embodiments of the invention, to provide a measurement corresponding to the drilling fluid pressure inside the drill string 35. Some embodiments of an instrumented sub 29, for example, may include a pressure sensor.

Figure 2:
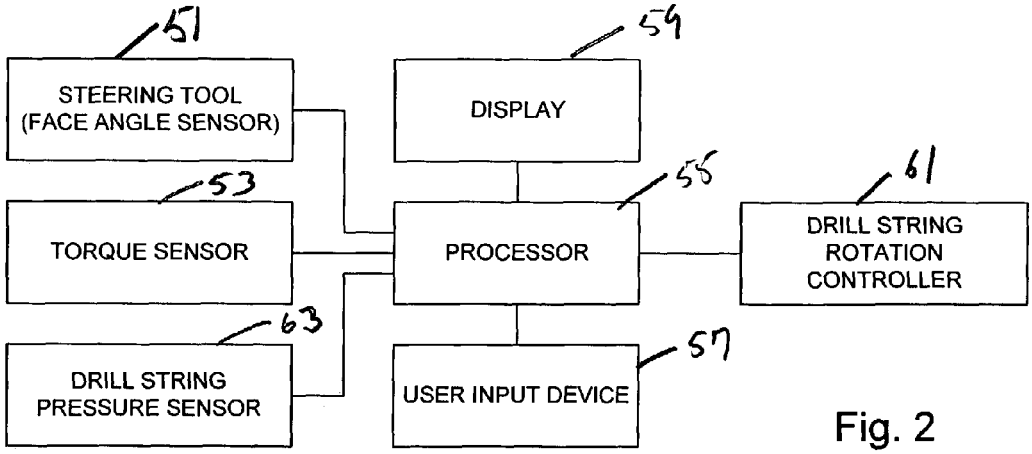
FIG. 2 is a block diagram of a directional driller control system according to the present invention.

FIG. 2 shows a block diagram of one embodiment of a system according to the present invention. The system of the present invention includes a steering tool or directional sensor (51 in FIG. 1) which produces a signal indicative of the tool face angle of the steerable motor (41 in FIG. 1). Typically, the directional sensor (51 in FIG. 1) uses mud pulse telemetry to send signals to a surface receiver (not shown), which outputs a digital tool face angle signal. Because of the limited data transmission rate of mud pulse telemetry, the tool face angle signal is produced at a rate of about once every twenty seconds. However, the sample rate for the tool face angle is not intended to limit the scope of the invention. The low data transmission rate is taken into account in performing some embodiments of a method according to the invention as will be further explained below.

The system of the present invention also includes a drill string torque sensor 53, which provides a measure of the torque applied to the drill string at the surface. The drill string torque sensor 53 may be implemented as a strain gage in the instrumented top sub (29 in FIG. 1). The torque sensor 53 may also be implemented as a current measurement device for an electric rotary table or top drive motor, or as a pressure sensor for an hydraulically or pneumatically operated top drive, as previously explained. The drill string torque sensor 53 provides a signal that may be sampled electronically at the preferred sampling rate of five times per second. Irrespective of the implementation used, the torque sensor 53 provides a measurement corresponding to the torque applied to the drill string 35 at the surface by the top drive 27 (or rotary table where the rig is so equipped).

In FIG. 2, the outputs of directional sensor 51, the torque sensor 53 and the pressure sensor 63 are received at or otherwise operatively coupled to a processor 55. The processor 55 is programmed, according to the present invention, to process signals received from the sensors 51, 53 and 63. The processor 55 also receives user input from user input devices, indicated generally at 57. User input devices 57 may include a keyboard, a touch screen, a mouse, a light pen, a keypad, or the like. The processor 55 may also provide visual output to a display 59. The processor 55 also provides output to a drill string rotation controller 61 that operates the top drive (27 in FIG. 1) or rotary table (not shown in the Figures) to rotate the drill string 35 in a manner according to the present invention.

Figure 3:
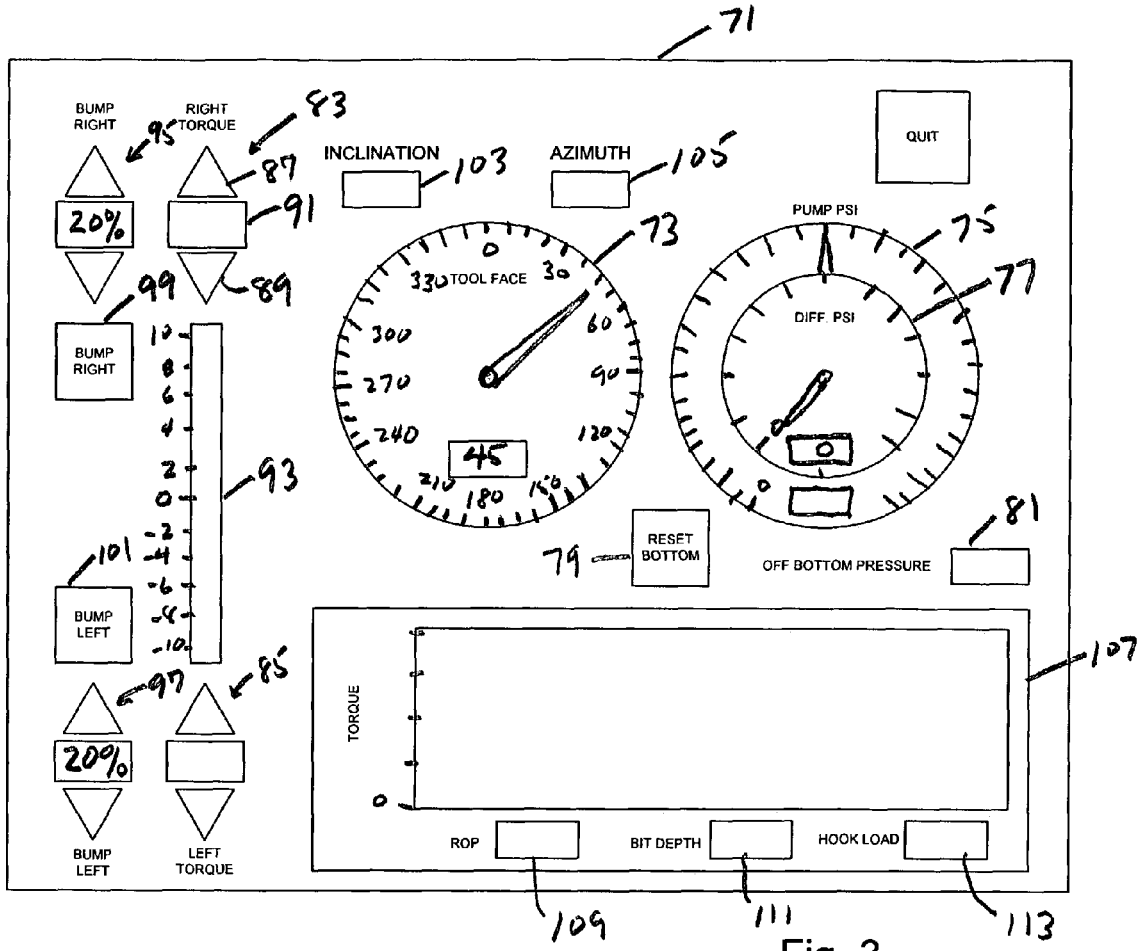
FIG. 3 is a pictorial view of a driller's screen according to the present invention.

FIG. 3, shows a driller's display screen 71 according to one embodiment of the present invention. Driller's screen 71 displays pertinent drilling information to the driller and provides a graphical user interface (in the form of a touch screen such as sold under the trade name FANUC by General Electric Co., Fairfield, Ct.) to the system of the present invention. Screen 71 includes a tool face indicator 73, which displays tool face angle derived from the output of steering tool 51 (FIGS. 1 and 2). In the illustrated embodiment, tool face indicator 73 is implemented as a combination dial and numerical indicator.

Screen 71 includes a combination pump (drilling fluid) pressure indicator 75 and differential pressure indicator 77. Pump pressure indicator 75 displays pressure information derived from pressure sensor 63 (FIG. 2) in dial and numerical form. Differential pressure displays the difference between off-bottom pump pressure and drill string pressure when the bit (40 in FIG. 1) is in contact with the bore hole bottom and is drilling earth formations. As is well-known to those skilled in the art, differential pressure is directly related to weight on bit. The higher the weight on bit, the higher the differential pressure. In directional drilling it is difficult or impossible to determine weight on bit directly because of friction between the drill string and the wall of the bore hole. Accordingly, weight on bit is typically inferred from differential pressure. Before commencing drilling according to the present invention, the driller begins circulating drilling fluid while the bit is off the bottom of the bore hole. A reset bottom control 79 is provided so that the driller can input the measured off-bottom pressure to the system. When the driller actuates reset control 79, the system captures the off-bottom pump (drilling fluid) pressure. The system displays the off-bottom pressure at 81 and uses the off-bottom pressure to calculate differential pressure.

The system of the present invention may include means for rocking (rotating) the drill string back and forth during sliding drilling. According to the present invention, the drilling motor (41 in FIG. 1) is oriented at a tool face angle selected to achieve a desired trajectory for the bore hole (33 in FIG. 1) during sliding drilling. As the drilling motor 41 is advanced axially into the bore hole (33 in FIG. 1) during sliding drilling, the processor (55 in FIG. 2) operates the drill string rotation controller (61 in FIG. 2) to rotate the drill string (35 in FIG. 1) in a first direction, while monitoring drill string torque using the torque sensor (53 in FIG. 2) and while monitoring tool face angle using the directional sensor (51 in FIG. 2).

In one embodiment, and referring back to FIG. 2, as long as the tool face angle remains substantially constant, the rotation controller 61 continues to rotate drill string (35 in FIG. 1) in the first direction. When the steering tool 51 senses a change in tool face angle, processor 55 records or stores the torque magnitude measured by the torque sensor 53 and actuates the drill string rotation controller 61 to reverse the direction of rotation of the drill string 31. The rotation in the opposite or second direction continues until a predetermined limit is reached, at which point drill string rotation is again reversed. Torque is a vector having a magnitude and a direction. When 5 rotation is resumed in the first direction, and the torque sensor 53 indicates that the magnitude of the drill string torque has reached the previously stored magnitude measured in the first direction, the processor 55 actuates rotation controller 61 to reverse the direction of rotation of drill string (31 in FIG. 1). As drilling progresses, the processor 55 continues to monitor the torque applied to the drill string (35 in FIG. 1) with the torque sensor 53 and actuates rotation controller 61 to rotate drill string 35 back and forth between the first torque magnitude and the second torque magnitude. The back and forth rotation reduces or eliminates stick/slip friction between the drill string and the bore hole, thereby making it easier for the driller to control weight on bit and tool face angle.

Alternatively, the torque magnitudes may be preselected by the system operator (typically the driller). When the torque detected by the sensor 53 reaches the preselected value, the processor 55 sends a signal to the controller 61 to reverse direction of rotation. The rotation in the reverse direction continues until a preselected torque magnitude is reached. In some embodiments, the first preselected torque magnitude is the same as the second magnitude. In some embodiments, the first and second preselected torque magnitudes are determined by calculating an expected rotational friction between the drill string (35 in FIG. 1) and the wellbore wall, such that the entire drill string above a selected point is rotated. The selected point is preferably a position along the drill string at which reactive torque from the motor (41 in FIG. 1) is stopped by friction between the drill string and the wellbore wall. The selected point may be calculated using "torque and drag" simulation computer programs well known in the art. Such programs calculate axial force and frictional/lateral force at each position along the drill string for any selected wellbore trajectory. One such program is sold by Maurer Technology, Inc., Houston, Tex. Alternatively, the first torque magnitude may be empirically determined by measuring an amount of torque applied to the drill string during "rotary" drilling and setting the first torque magnitude to a value less than the torque applied during rotary drilling. Irrespective of how the first and second torque magnitudes are determined, typically the absolute value of the second torque magnitude will be less than the absolute value of the first torque magnitude, because rotation in the second direction results in both surface-applied torque and reactive torque from the drilling motor being applied to the drill string in the same direction of rotation.

Referring again to FIG. 3, screen 71 includes rocking torque controls. More specifically, there is provided right-hand torque controls 83 and left-hand torque controls 85. Right torque controls 83 include an up arrow control 87 and down arrow control 89. Actuation of up arrow control 87 increases the right torque magnitude during rocking. Actuation of down arrow control 89 decreases the right torque magnitude. The right torque magnitude is displayed in a box 91. Similarly, left torque controls 85 include an up arrow control, a down arrow control and a torque magnitude box. Torque controls 83 and 85 enable the driller to set the left and right rocking torque magnitudes manually. A handle speed indicator 93 is positioned between torque controls 83 and 85.

In a method according to one aspect of the present invention, the processor (55 in FIG. 2) is programmed to operate the drill string rotation controller (61 in FIG. 2) to rotate the drill string (35 in FIG. 1) back and forth between the first and second torque values. The processor 55 also accepts as input signals from the pressure sensor 63. The processor 55 can be programmed to adjust the first and second torque values in response to changes in the drilling fluid pressure as measured by the pressure sensor 63 such that a selected value of drilling fluid pressure is maintained. As is known in the art, as the drawworks (23 in FIG. 1) is operated to release the drill string (35 in FIG. 1) into the bore hole (33 in FIG. 1), a portion of the weight of the drill string (35 in FIG. 1) is transferred to the drill bit (40 in FIG. 1). However, particularly during sliding drilling, much of the weight of the drill string (35 in FIG. 1) is not transferred to the bit (40 in FIG. 1) because of friction between the drill string (35 in FIG. 1) and the wall of the bore hole (33 in FIG. 1), as explained above. Rotating the drill string (35 in FIG. 1) between the first and second torque values reduces the amount of friction between the drill string and the wall of the bore hole. Reducing the friction enables more of the weight of the drill string (35 in FIG. 1) to be transferred to the drill bit (40 in FIG. 1) for any particular amount of "slack off" (reduction in the amount of drill string weight measured at the top drive). As is also known in the art, as the amount of weight transferred to the drill bit (40 in FIG. 1) increases, the pressure inside the drill string tends to increase, because the torque load on the drilling motor (41 in FIG. 1) correspondingly increases. As is also known in the art, each type of drilling motor has a preferred operating differential pressure. In a method according to one embodiment of the present invention, the processor 55 is programmed to operate the drill string rotation controller 61 to rotate the drill string (35 in FIG. 1) between the first and second torque values. If the pressure in the drill string (35 in FIG. 1) falls below a selected set point or threshold (which may be made to correspond to a selected differential pressure by setting the off-bottom pressure value as explained above), the first and second torque values may be increased automatically by the processor 55. If the drilling fluid pressure reaches the selected set point or threshold, the torque values may be maintained substantially constant. If the pressure in the drill string rises above the selected threshold or set point, the torque values may be reduced. By maintaining torque values such that the drill string pressure is maintained at a preferred or preselected value, a rate of penetration of the drill bit through the earth formations may be increased, while reducing the risk of "stalling" the drilling motor (exceeding the torque capacity of the motor causing bit rotation to stop). As is known in the art, stalling the drilling motor reduces its expected life and increases the risk of damage to the motor by distending elastomeric elements in the stator of the drilling motor (41 in FIG. 1). The preselected value of drill string pressure, or set point, is preferably about equal to the preferred operating pressure of the drilling motor (41 in FIG. 1), less a safety factor, if desired.

In some embodiments, the amount of torque applied to the drill string during rocking may be momentarily increased above the selected value, for example, during one or two rotations in either the first or second directions, to make adjustments in the tool face angle. For example, if the driller desires to adjusts the tool face angle in a clockwise direction ("to the right" as referred to in the art) the amount of torque applied during clockwise rotation of the drill string may be increased above the selected value, to an amount which causes some rotation of the steerable motor in a clockwise direction. As will be readily appreciate by those skilled in the art, the amount of torque needed to move the tool face angle in a clockwise direction is an amount which exceeds the friction between the drill string and the bore hole as well as the reactive torque of the steerable motor.

Correspondingly, if the driller desires to make a counterclockwise adjustment ("to the left" as referred to in the art) to the tool face angle, the amount of torque applied to the drill string during counterclockwise rotation may be momentarily set above the predetermined or selected value so as to overcome the friction between the drill string and the bore hole. As will also be readily appreciated by those skilled in the art, adjustment "to the left" will typically require less torque than adjustment "to the right" because the reactive torque of the steerable motor during drilling applies a counterclockwise torque to the drill string above the drilling (steerable) motor. The processor 55 may be programmed to include an adjustment feature which provides an increase in rotation torque above the selected value in either the clockwise or counterclockwise directions for a selected number of rotations, e.g. one or two rotations, to provide an adjustment to the tool face angle. After the selected number of rotations, the torque applied is returned to the preselected value to maintain the tool face angle; substantially constant. The process of momentarily causing the selected first or second torque magnitudes to be exceeded in order to change the tool face angle, will be referred to herein for convenience as "bumping."

Referring once again to FIG. 3, screen 71 includes right bump controls 95 and left bump controls 97. Bump controls 95 and 97 each include up and down arrow controls and an indicator box. The indicator box boxes display the additional torque to be applied in correcting tool face angle, expressed as a percentage of left or right torque. Thus, the driller can set the amount of additional torque to be applied by use of the up and down arrows. Right bump controls 95 include a bump right button 99. Similarly, bump left controls include a bump left button 101. The driller can cause the system to bump the string right or left by actuating right bump button 99 or left bump button 101, respectively.

In another aspect, and referring back once again to FIG. 2, the processor 55 may be programmed to operate the drill string rotation controller 61 to rotate the drill string a first selected amount (an amount of total angular displacement) in a first direction, and reverse rotation and rotate the drill string to a second selected amount (total angular displacement). In a method according to this aspect of the invention, the pressure measurements conducted to the processor 55 from the pressure sensor 63 are used to adjust the first and second amounts of rotation. In one embodiment, the amounts of rotation are decreased when the drill string pressure increases. The amounts of rotation are increased when the drill string pressure decreases. The amounts of rotation are adjusted in order to maintain the drill string pressure substantially constant. More preferably, the drill string pressure is maintained substantially at the preferred operating pressure of the drilling motor.

Controlling the total amount of rotation to maintain a substantially constant drill string pressure, and more preferably the preferred operating pressure of the drilling motor, may reduce the incidence of drilling motor stalling and may improve the life of the drilling motor (41 in FIG. 1).

In some embodiments, the amount of rotation applied to the drill string may be momentarily increased above the selected value, for example, during one or two rotations in either the first or second directions, to make adjustments in the tool face angle. For example, if the driller desires to adjusts the tool face angle in a clockwise direction ("to the right" as referred to in the art) the amount of rotation applied during clockwise rotation of the drill string may be increased above the selected value, to an amount which causes some rotation of the steerable motor in a clockwise direction. As will be readily appreciate by those skilled in the art, the amount of rotation needed to move the tool face angle in a clockwise direction is an amount which exceeds the friction between the drill string and the bore hole as well as the reactive torque of the steerable motor.

Correspondingly, if the driller desires to make a counterclockwise adjustment ("to the left" as referred to in the art) to the tool face angle, the amount of rotation applied to the drill string during counterclockwise rotation may be momentarily set above the predetermined or selected value so as to overcome the friction between the drill string and the bore hole. As will also be readily appreciated by those skilled in the art, adjustment "to the left" will require less rotation than adjustment "to the right" because the reactive torque of the steerable motor during drilling applies a counterclockwise torque to the drill string above the drilling (steerable) motor. The processor 55 may be programmed to include an adjustment feature which provides an increase in rotation amount above the selected value in either the clockwise or counterclockwise directions for a selected number of rotations, e.g. one or two rotations, to provide an adjustment to the tool face angle. After the selected number of rotations, the amount of rotation applied is returned to the preselected value to maintain the tool face angle substantially constant.

Referring again to FIG. 3, screen 71 includes additional informational display items. Inclination and azimuth values are displayed in boxes 103 and 105, respectively. A graphical plot of torque versus time is displayed at 107. Surface rate of penetration, bit depth and hook load are displayed in boxes 109, 111 and 113, respectively.

Figure 4:
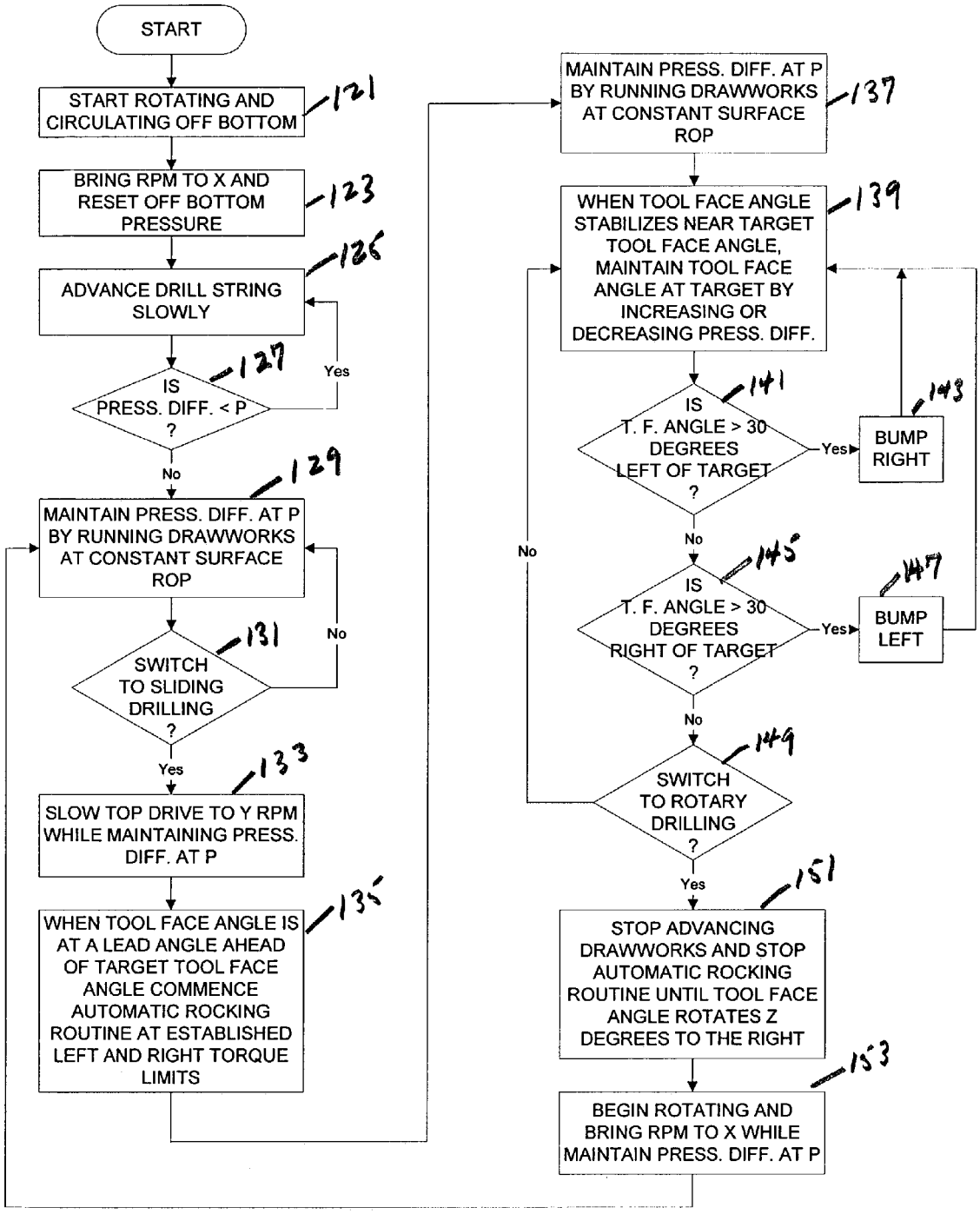
FIG. 4 is a flowchart of one embodiment of the present invention.

Referring now to FIG. 4, there is illustrated a flowchart of one embodiment of a method according to the present invention. Initially, the driller starts rotating the drill string and circulating drilling fluid, at block 121. The driller brings the rate of drill string rotation to the desired operating rate and resets the off-bottom pressure, by actuating control 79 (FIG. 3), at block 123. Then the driller axially advances the drill string slowly, as indicated at block 125, until the differential pressure is equal to a target P, as indicated at decision block 127. The driller then drills in rotary mode by maintaining the rate of advance of the drill string so that the differential pressure is maintained substantially at target P.

Alternatively, the driller may operate the drawworks at a constant surface rate of penetration, at block 129.

The driller continues to drill in the rotary mode until he decides, as indicated at decision block 131, to switch to sliding mode, typically to change the trajectory of the bore hole. To enter the sliding mode, the driller slows the speed of rotation of the string while maintaining differential pressure at P, as indicated at block 133, or alternatively, maintains the rate of advance of the drill string constant. Preferably, the rate of drill string rotation is slowed such that the driller can reasonably estimate the expected tool face orientation of the drilling motor from the signals transmitted relatively slowly by the directional sensor. The slow rate of rotation may be in a range of 0.5 to 2 RPM depending on the data transmission rate of tool face information from the directional sensor (51 in FIG. 1). In one example, when the tool face angle is measured to be at an angle of about ninety degrees ahead of the target-tool face angle, the driller stops rotation of the drill string and actuates the automatic rocking routine as described above at the established left and right torque limits, as indicated at block 135. The target tool face angle is that which will achieve the selected bore hole trajectory. The driller maintains the pressure differential at the target P by controlling surface rate of penetration, as indicated at block 137, or, as previously explained, by automatically adjusting the torque magnitudes to maintain the drilling fluid pressure (or pressure differential) substantially at the preferred value. When the tool face angle stabilizes, the driller maintains the tool face angle of the drilling motor at the target during sliding mode.

If the tool face angle is near the target, for example, less than about thirty degrees from the target, the driller can adjust the tool face angle by increasing or decreasing pressure differential as appropriate, as indicated at block 139. The driller increases pressure differential (and weight on bit) in this example, by advancing the drill string faster. Conversely, The driller can decrease pressure differential by advancing the drill string slower. Due to reactive torque, increasing differential pressure moves the tool face to the left (counterclockwise)., Decreasing differential pressure moves the tool face to the right (clockwise).

If the tool face angle is substantially different from the target, for example greater than about thirty degrees, the driller can correct the tool face angle with the bump controls described above with reference to FIG. 3. If the tool face angle is more than about thirty degrees left of the target, as indicated at decision block 141, the driller actuates the bump right button (99 in FIG. 3), as indicated at block 143. If the tool face angle is more than thirty degrees right of the target, as indicated at decision block 145, the driller actuates the bump right button (101 in FIG. 3), as indicated at block 147.

The driller continues in sliding mode until he decides, as indicated at decision block 149, to return to rotary mode. In the present embodiment, returning to rotary drilling mode includes the following. The driller temporarily stops advancing the drill string and stops the rocking routine until the tool face angle of the drilling motor rotates a selected amount, for example about thirty degrees, as indicated at block 151. Stopping advancing the drill string allows a certain amount of the weight on bit to "drilled off" before starting rotate the drill string. Rotation of the drill string will cause some of the weight supported by the bore hole to be transferred to the bit. Drilling off some of the weight substantially prevents drilling motor stalling when rotary drilling is resumed. As will be readily appreciated by those skilled in the art, when rotary drilling (by resuming drill string rotation from the surface) is resumed, friction between the drill string and the wall of the bore hole is substantially reduced. Sudden reduction of friction may result in too-rapid transfer of drill string weight to the drill bit, thus risking stalling the drilling motor.

When sufficient weight has been drilled off, the driller begins rotating the string and brings the speed of rotation to the selected surface rate of rotation. In some embodiments the driller may adjust the rate of advance of the drill string to maintain the pressure differential at the target P, as indicated at block 153. Alternatively, the driller can control the advance of the drill string to maintain a substantially constant measured hook weight, to maintain a substantially constant rate of advance, or to advance at an optimized rate. Then the driller returns in the process to block 129. The driller can alternate according to the present invention back and forth between rotary mode and sliding mode while the bit remains in substantially continuous contact with the bottom of the bore hole.

Figure 5:
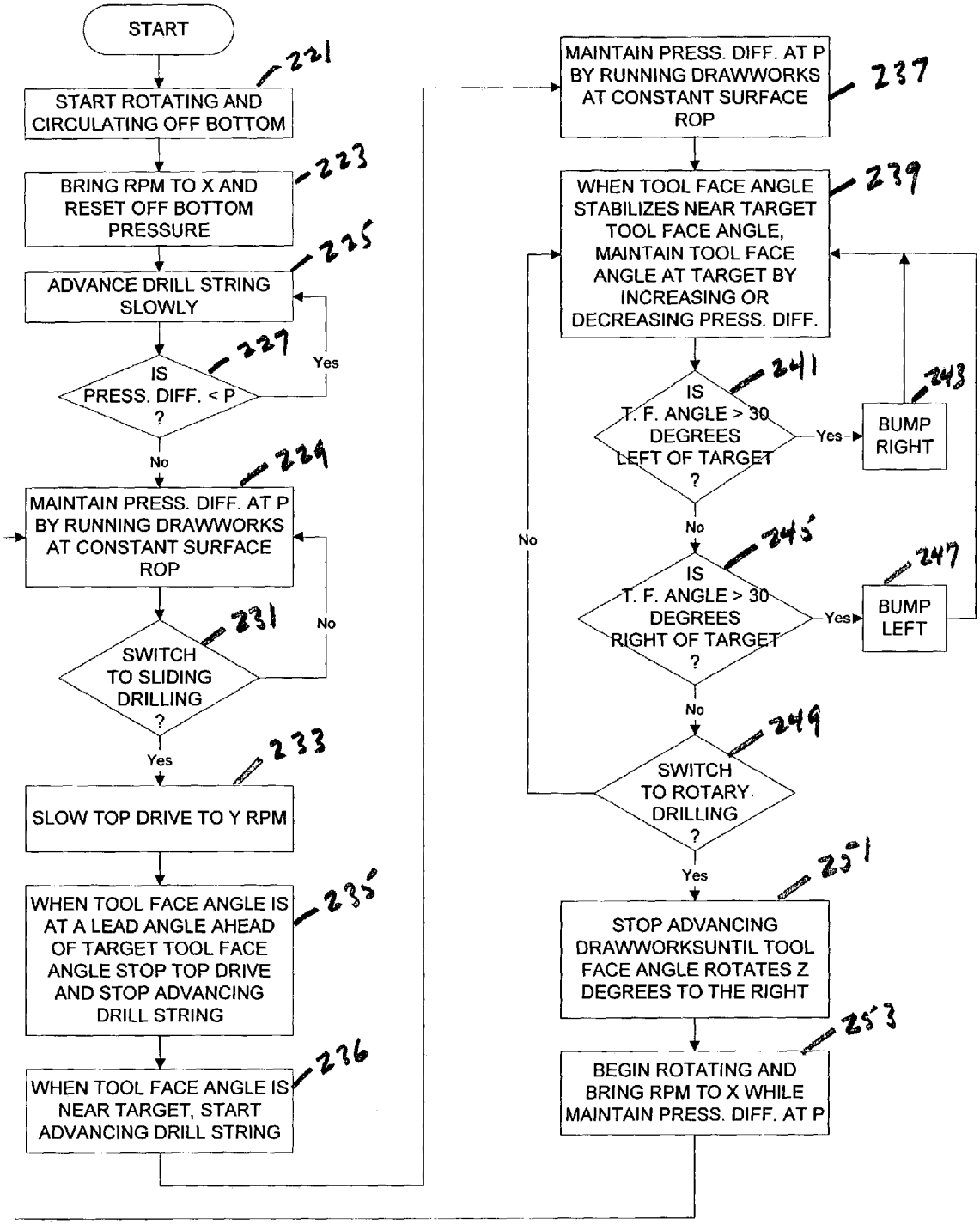
FIG. 5 is a flowchart of a second embodiment of the present invention.

Referring now to FIG. 5, there is illustrated a flowchart of an alternative method according to the present invention. The method of FIG. 5 does not include rocking the drill string during sliding mode. Initially, the driller starts rotating the drill string and circulating drilling fluid, at block 221. The driller brings the speed of rotation to the desired operating rate and resets the off-bottom pressure, by actuating the control (79 in FIG. 3), at block 223. Then the driller advances the drill string slowly, as indicated at block 225, until the differential pressure is equal to a target P, as indicated at decision block 227. The driller then drills in rotary mode by operating the drawworks to maintain the differential pressure at the target P. Alternatively, the driller may operate the drawworks at a constant surface rate of penetration (rate of release of the drill string), at block 229. The driller may also operate the drawworks to maintain an optimized rate of release of the drill string. Methods known in the art for determining an optimized rate of penetration are disclosed, for example, in U.S. Pat. No. 6,155,357 issued to King et al. and assigned to the assignee of the present invention.

The driller continues to drill in the rotary mode until he decides, as indicated at decision block 231, to switch to sliding mode. To enter sliding mode, the driller slows the speed of rotation of the string while operating the drawworks to maintain differential pressure at P, as indicated at block 233. When the tool face angle is at an angle of about ninety degrees with respect to, preferably ahead of, the target tool face angle, the driller stops rotating the top drive and stops advancing the drill string, as indicated at block 235. Stopping advancing the drill string causes a portion of the weight on bit to be drilled off, which in turn causes the drilling motor to rotate toward the target tool face angle. When the tool face angle rotates to within about forty-five degrees of the target, the driller again starts advancing the drill string, as indicated at block 236. The driller advances the drill string to maintain the pressure differential at the target P, as indicated at block 237. When the tool face angle stabilizes, the driller maintains the tool face angle of the drilling motor at the target during sliding mode. If the tool face angle is near the target, for example, within about thirty degrees, the driller can adjust the tool face angle by increasing or decreasing pressure differential as appropriate, as indicated at block 239. The driller may also activate the automatic rocking procedure as explained above.

If the tool face angle is substantially different from the target, for example greater than about thirty degrees, the driller corrects the tool face angle with the bump controls described with reference to FIG. 3. If the tool face angle is more than thirty degrees left of the target, as indicated at decision block 241, the driller actuates the bump right button (99 in FIG. 3), as indicated at block 243. If the tool face angle is more than thirty degrees right of the target, as indicated at decision block 245, the driller actuates the bump right button (101 in FIG. 3), as indicated at block 247.

The driller continues in sliding mode until he decides, as indicated at decision block 249, to return to rotary mode. The driller temporarily stops advancing the drill string and stops the rocking routine until the tool face angle of the drilling motor rotates a selected amount, for example thirty degrees, as indicated at block 251. Stopping advancing the drill string allows a certain amount of the weight on bit to drilled off before starting rotate the drill string. Rotation of the drill string will cause some of the weight supported by the bore hole to be transferred to the bit. Drilling off some of the weight prevents bit stalling. When sufficient weight has been drilled off, the driller begins rotating the string and brings the speed of rotation to the selected rotation speed while operating the drawworks to maintain the pressure differential at the target P, as indicated at block 253. Alternatively, the driller can operate the drawworks to maintain a constant hook load, a constant rate of advance or an optimized rate of advance of the drill string. Then the driller returns the process to block 229. The driller can alternate, according to the present invention, back and forth between rotary mode and sliding mode while the bit remains in substantially continuous contact with the bottom of the bore hole.

Figure 6:
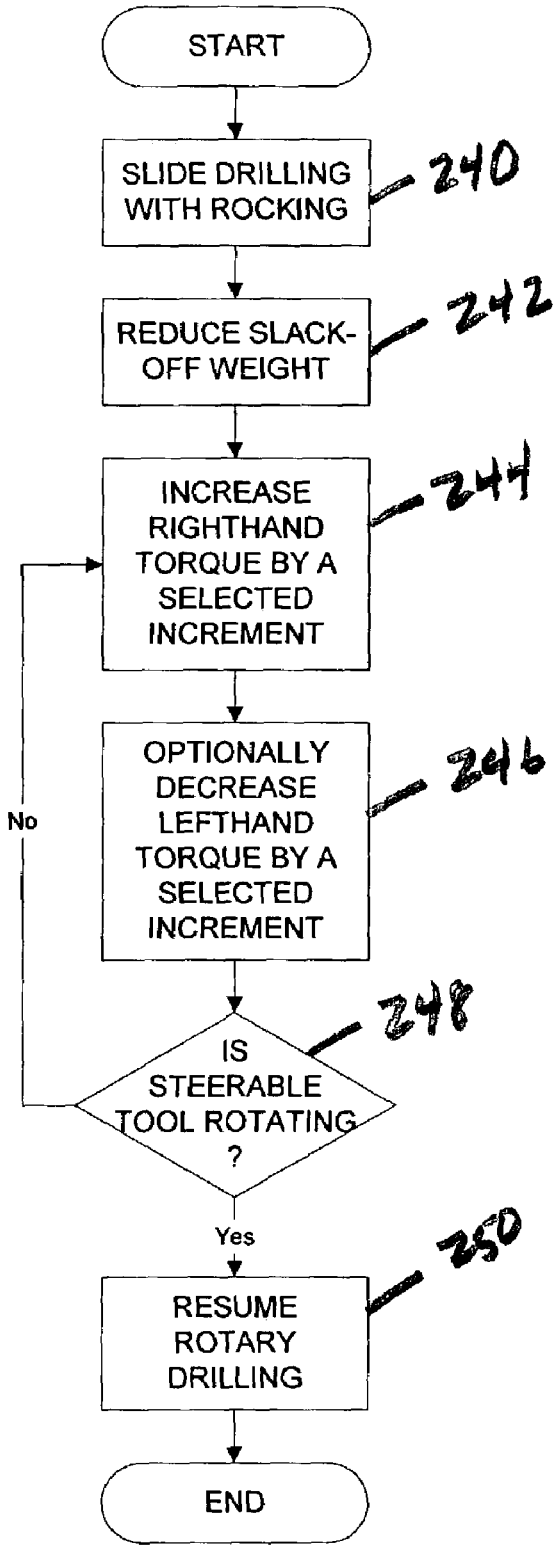
FIG. 6 is a flowchart of a different embodiment of a method according to the invention.

An alternative embodiment of a method according to the invention includes changing from slide drilling to rotary drilling according to the following procedure explained with reference to the flow chart in FIG. 6. At 240, sliding drilling, including rocking the drill string according to the procedures explained above, is underway. When the driller decides to resume rotary drilling, first, at 242, the suspended weight of the drill string (slack off weight) may be reduced. Alternatively, the driller may slow the rate of release of the drill string and allow the weight on the drill bit to "drill off." Next, at 244, the amount of right hand torque is increased above the first selected-magnitude by a selected increment. A typical-value of the increment is about twenty percent, but other increments may be used depending on the configuration of the drill string and the trajectory of the bore hole. Optionally, at 246, the left hand torque magnitude (second magnitude) may be reduced by a selected decrement. Typical values for the selected decrement are about five to twenty percent, but as is the case for the selected increment, the value may be adjusted to reflect the drill string configuration and wellbore trajectory. Rocking continues by increasing the right hand torque for each right hand rotation of the drill string by the selected increment until the steerable tool begins to rotate, as indicated at decision block 248, at which point rotary drilling is resumed, at block 250. The incremental increase in the right hand torque may be accompanied by a corresponding decrease in the left hand torque for each rocking cycle until the drill string resumes rotation. In some embodiments, the processor (55 in FIG. 2) may be programmed to automatically increment and/or decrement the torque magnitudes automatically. When the drill string resumes normal rotation the driller may increase the rotation rate (RPM) to a selected value and resume releasing the drill string into the bore hole at a selected rate. As stated above, the selected rate may be one which results in an optimal rate of penetration, maintains a constant drilling fluid pressure, or maintains a constant measured "hookload" (apparent weight on bit).

While the invention has been disclosed with respect to a limited number of embodiments, those of ordinary skill in the art, having the benefit of this disclosure, will readily appreciate that other embodiments may be devised which do not depart from the scope of the invention. Accordingly, the scope of the invention is intended to be limited only by the attached claims.

What is claimed is:

1. A method of drilling a bore hole, comprising:

alternating between rotary drilling and sliding drilling using a steerable drilling motor while a drill bit remains in substantially continuous contact with a bottom of said bore hole, said steerable drilling motor being connected by a drill string to a surface drilling location.

2. The method as claimed in claim 1, further comprising:

rotating said drill string in said bore hole at a first speed of rotation.

3. The method as claimed in claim 2, further comprising:

advancing said drill string in said bore hole at a rate selected to substantially maintain a target drilling fluid pressure.

4. The method as claimed in claim 2, further comprising:

slowing rotation of said drill string to a second speed of rotation.

5. The method as claimed in claim 4, further comprising:

stopping rotation of said drill string when said steerable motor is at a first selected angle with respect to a target tool face angle; and stopping advancing said drill string.

6. The method as claimed in claim 5, further comprising:

advancing said drill string when said steerable drilling motor is at a second selected angle with respect to said target tool face angle.

7. The method as claimed in claim 6, further comprising:

maintaining the second selected angle of said steerable drilling motor with respect to said target tool face angle.

8. The method as claimed in claim 7, wherein maintaining said tool face angle of said steerable drilling motor at said target tool face angle comprises:

adjusting at lease one of a rate of release of said drill string into said well bore, and an amount of rocking said drill string in a first direction and in a second direction so as to maintain said drilling fluid pressure at a selected value.

9. The method as claimed in claim 7, wherein maintaining said tool face angle of said steerable drilling motor at said target tool face angle comprises: rotating said drill string.

10. The method as claimed in claim 7, wherein maintaining said tool face angle of said steerable drilling motor at said target tool face angle comprises: applying a selected torque to said drill string.

11. The method as claimed in claim 7, further comprising:

stopping advancing said drill string; and when tool face angle of said steerable drilling tool moves a selected amount, rotating and advancing said drill string.

12. The method as claimed in claim 6, further comprising:

commencing rocking said drill string when said steerable motor is at the second selected angle with respect to the target tool face angle.

13. The method as claimed in claim 12, wherein said rocking comprises: rotating said drill string in a first direction until a first torque magnitude is reached at said surface location; and rotating said drill string in a second direction opposite said first direction until a second torque magnitude is reached at said surface location.

14. The method as claimed in claim 13, wherein said first and second torque magnitudes are less than a torque required to rotate said steerable drilling motor in the well bore.

15. The method as claimed in claim 13, further comprising: maintaining the tool face angle of said steerable drilling motor at said target tool face angle.

16. The method as claimed in claim 15, wherein maintaining said tool face angle of said steerable drilling motor at said target tool face angle comprises: adjusting at least one of a rate of release of said drill string into said well bore, and the first and the second selected torque magnitudes so as to maintain a drilling fluid pressure at a selected value.

17. The method as claimed in claim 15, wherein maintaining said tool face angle of said steerable drilling motor at said target tool face angle comprises: adjusting one of said first and second torque magnitudes.

18. The method as claimed in claim 17, wherein adjusting one of said first and second magnitudes includes: adjusting said first magnitude if said tool face angle of said steerable drilling motor differs from said target tool face angle in said second direction; and, adjusting said second magnitude if said tool face angle of said steerable drilling motor differs from said target tool face angle in said first direction.

19. The method as claimed in claim 15, including: stopping advancing said drill string and said rocking; and when tool face angle of said steerable drilling tool moves a selected angle, rotating and advancing said drill string.

20. A method of drilling a bore hole, comprising:

rotating and advancing a drill string having a steerable motor connected thereto in said bore hold, said drill string having a bit at a bottom end thereof, said bit being in contact with a bottom of said well bore, thereby drilling in a rotary mode; and after drilling in said rotary mode, stopping rotation of said drill string and continuing to advance said drill string with said bit in substantially continuous contact with said bottom, thereby drilling in a sliding mode.

21. The method as claimed in claim 20, wherein said rotating and advancing comprises: rotating said drill string in said bore hole at a first speed of rotation.

22. The method as claimed in claim 21, wherein said rotating and advancing comprises: advancing said drill string in said bore hole at a rate selected to maintain a target drilling fluid pressure.

23. The method as claimed in claim 22, wherein said stopping said rotation comprises: slowing rotation of said drill string to a second speed of rotation while maintaining said target drilling fluid pressure differential.

24. The method as claimed in claim 23, wherein said stopping rotation comprises: stopping rotation of said drill string when said steerable motor is at a first selected angle with respect to a target tool face angle; and, temporarily stopping advancing said drill string while said bit remains in contact with said bottom.

25. The method as claimed in claim 24, comprising: advancing said drill string when said steerable drilling motor is a second selected angle with respect to said target tool face angle.

26. The method as claimed in claim 25, comprising: maintaining said steerable drilling motor at said target tool face angle.

27. The method as claimed in claim 26, wherein maintaining said tool face angle of said steerable drilling motor at said target tool face angle comprises: adjusting at least one of a rate of release of said drill string and an amount of rocking of said drill string in a first direction and in a second direction so as to maintain said drilling fluid pressure substantially constant.

28. The method as claimed in claim 26, wherein maintaining said tool face angle of said steerable drilling motor at said target tool face angle comprises: rotating said drill string.

29. The method as claimed in claim 26, wherein maintaining said tool face angle of said steerable drilling motor at said target tool face angle comprises: applying a selected torque to said drill string.

30. The method as claimed in claim 20, further comprising: after drilling in said sliding mode, rotating and advancing said drill string in said bore hole with said bit in substantially continuous contact with said bottom, thereby drilling in said rotary mode.

31. The method as claimed in claim 30, further comprising: after drilling in said sliding mode, temporarily stopping advancing said drill string with said bit in contact with said bottom; and rotating and advancing said drill string when said tool face angle of said steerable drilling tool moves a selected angle.

32. The method as claimed in claim 20, further comprising: stopping rotation of said drill string during said rotary mode when said steerable motor is at a selected angle with respect to a target tool face angle and commencing rocking said drill string in said sliding mode.

33. The method as claimed in claim 32, wherein said rocking comprises: rotating said drill string in a first direction until a first torque magnitude is reached at said surface location; and, rotating said drill string in a second direction opposite said first direction until a second torque magnitude is reached at said surface location.

34. The method as claimed in claim 33, wherein said first and second torque magnitudes are less than the torque required to rotate said steerable drilling motor in said well bore.

35. The method as claimed in claim 33, further comprising: maintaining said steerable drilling motor at said target tool face angle in said sliding mode.

36. The method as claimed in claim 35, wherein maintaining said tool face angle of said steerable drilling motor at said target tool face angle comprises: adjusting at least one of a rate of release of said drill string, said first torque magnitude and said second torque magnitude so as to maintain said drilling fluid pressure differential substantially constant.

37. The method as claimed in claim 35, wherein maintaining said tool face angle of said steerable drilling motor at said target tool face angle comprises: adjusting one of said first and second torque magnitudes.

38. The method as claimed in claim 37, wherein adjusting one of said first and second magnitudes comprises: adjusting said first magnitude if said tool face angle of said steerable drilling motor differs from said target tool face angle in said second direction; and, adjusting said second magnitude if said tool face angle of said steerable drilling motor differs from said target tool face angle in said first direction.

39. The method as claimed in claim 32, further comprising: after drilling in said sliding mode, rotating and advancing said drill string in said bore hole with said bit in substantially continuous contact with said bottom, thereby drilling in said rotary mode.

40. The method as claimed in claim 39, further comprising: stopping advancing said drill string and said rocking; and rotating and advancing said drill string when tool face angle of said steerable drilling tool moves a selected angle.

41. A method of drilling a bore hole, comprising:

advancing a drill string having a steerable drilling motor connected thereto in said bore hole, said steerable drilling motor having a tool face angle, said drill string having a bit at a bottom end thereof, said bit being in substantially continuous contact with a bottom of said well bore, thereby drilling in a sliding mode;

rotating said drill string and continuing to advance said drill string with said bit in substantially continuous contact with said bottom after drilling in said sliding mode, thereby drilling in a rotary mode; and rocking said drill string in said sliding mode.

42. The method as claimed in claim 41, further comprising: maintaining said steerable drilling motor at a target tool face angle when drilling in said sliding mode.

43. The method as claimed in claim 42, wherein maintaining said tool face angle of said steerable drilling motor at said target tool face angle comprises: adjusting at least one of a rate of release of said drill string and an amount of rotation of said drill string in a first direction and a second direction so as to maintain a drilling fluid pressure substantially constant.

44. The method as claimed in claim 42, wherein maintaining said steerable drilling motor at said target tool face angle comprises: rotating said drill string to a selected surface torque value.

45. The method as claimed in claim 42, wherein maintaining said steerable drilling motor at said target tool face angle comprises: applying a selected torque to said drill string.

46. The method as claimed in claim 41, further comprising: after drilling in said sliding mode, temporarily stopping advancing said drill string with said bit in contact with said bottom; and rotating and advancing said drill string in said rotary mode when said tool face angle of said steerable drilling tool moves a selected angle.

47. The method as claimed in claim 41, wherein said rocking comprises:

rotating said drill string in a first direction until a first torque magnitude is reached at said surface location;

and rotating said drill string in a second direction opposite said first direction until a second torque magnitude is reached at said surface location.

48. The method as claimed in claim 47, wherein said first and second torque magnitudes are less than the torque required to rotate said steerable drilling motor.

49. The method as claimed in claim 47, further comprising:

maintaining said steerable drilling motor at said target tool face angle during said sliding mode.

50. The method as claimed in claim 49, wherein maintaining said tool face angle of said steerable drilling motor at said target tool face angle comprises: adjusting at least one of said first torque magnitude and said second torque magnitude so that said drilling fluid pressure differential remains substantially constant.

51. The method as claimed in claim 49, wherein maintaining said steerable drilling motor at said target tool face angle comprises:

adjusting at least one of said first torque magnitude, said second torque magnitude an angular displacement in said first direction and an angular displacement in said second direction.

52. The method as claimed in claim 51, wherein the adjusting comprises:

adjusting at least one of said first magnitude and said angular displacement in said first direction if said tool face angle of said steerable drilling motor differs from said target tool face angle in said second direction; and, adjusting at least one of said second magnitude and said angular displacement in said second direction if said tool face angle of said steerable drilling motor differs from said target tool face angle in said first direction.

53. The method as claimed in claim 47, including:

temporarily stopping advancing said drill string; stopping said rocking routine; and rotating and advancing said drill string in said rotary mode when tool face angle of said steerable drilling tool moves a selected angle.

54. A method of directional drilling, which comprises:

(a) orienting a steerable drilling motor at a target tool face angle, said steerable drilling motor being connected by a drill string to a surface drilling location;

(b) rocking said drill string by:

(i) rotating said drill string at said surface location in a first direction until a first torque magnitude is reached at said surface location substantially without changing a tool face angle of said steerable drilling motor; and (ii) rotating said drill string at said surface location in a second direction opposite said first direction until a second torque magnitude is reached without changing the face angle of said steerable drilling motor; and (c) maintaining the tool face angle of said steerable drilling motor at said target tool face angle by adjusting at least one of said first and second torque magnitudes for least one drill string rotation in the first and second direction.

55. The method as claimed in claim 54, wherein adjusting one of said first and second magnitudes comprises: adjusting said first magnitude if said tool face angle of said steerable drilling motor differs from said target tool face angle in said second direction; and, adjusting said second magnitude if said tool face angle of said steerable drilling motor differs from said target tool face angle in said first direction.

56. The method as claimed in claim 54, wherein adjusting one of said first and second magnitudes comprises:

measuring a drilling fluid pressure; and adjusting at lease one of the first and second magnitudes to maintain the drilling fluid pressure substantially constant.

57. A directional drilling system, which comprises:

a steerable drilling motor;

a steering tool operatively coupled to said steerable drilling motor, said steering tool being adapted to produce a tool face angle signal;

a drill string coupled to said steerable drilling motor;

a drill string torque sensor operatively coupled to said drill string, said torque sensor being adapted to produce a drill string torque signal;

means for rotating said drill string at a surface location;

a controller for operating said rotating means to rotate said drill string cyclically back and forth in a first direction until a first torque magnitude is reached and then in a second direction opposite said first direction until a second torque magnitude is reached; and, a bump control for adjusting at least one of said first and second torque magnitudes for at least one cycle.

58. The system as claimed in claim 57, wherein said bump control includes for increasing said first and second magnitudes by user specified amounts.

59. A method for directional drilling, comprising:

advancing a drill string including a bit and a drilling motor thereon along a bore hole, the drilling motor oriented at a selected tool face angle;

rotating the drill string in a first direction until a first torque magnitude is reached;

rotating the drill string in a second direction opposite to the first direction until a second torque magnitude is reached;

reducing a rate of release of the drill string into the bore hole;

repeating rotating the drill string in the first direction to a torque value increased by a selected amount above the previous torque magnitude in the first direction; and repeating the rotating the drill string in the second direction, rotating attain in the first direction and increasing the torque until the drill string rotates substantially continuously in the first direction.

60. The method of claim 59 further comprising decreasing the torque in the second direction by a selected amount each time the drill string is rotated in the second direction.

61. A method of drilling a bore hole, comprising:

advancing a drill string having a steerable drilling motor connected thereto in said bore hole, said steerable drilling motor having a tool face angle, said drill string having a bit at a bottom end thereof, said bit being in substantially continuous contact with a bottom of said well bore, thereby drilling in a sliding mode;

rocking said drill string in said sliding mode; and maintaining said steerable drilling motor at a target tool face angle when drilling in said sliding mode.

62. The method as claimed in claim 61, wherein maintaining said tool face angle of said steerable drilling motor at said target tool face angle comprises:

adjusting at least one of a rate of release of said drill string and an amount of rotation of said drill string in a first direction and a second direction so as to maintain a drilling fluid pressure substantially constant.

63. The method as claimed in claim 61, wherein maintaining said steerable drilling motor at said target tool face angle comprises rotating said drill string to a selected surface torque value.

64. The method as claimed in claim 61, wherein said rocking comprises: rotating said drill string in a first direction until a first torque magnitude is reached at said surface location; and rotating said drill string in a second direction opposite said first direction until a second torque magnitude is reached at said surface location.

65. The method as claimed in claim 64, wherein said first and second torque magnitudes are less than the torque required to rotate said steerable drilling motor.

66. The method as claimed in claim 61, wherein maintaining said tool face angle of said steerable drilling motor at said target tool face angle comprises adjusting at least one of said first torque magnitude and said second torque magnitude so that said drilling fluid pressure differential remains substantially constant.

67. The method as claimed in claim 61, wherein maintaining said steerable drilling motor at said target tool face angle comprises:

adjusting at least one of said first torque magnitude, said second torque magnitude an angular displacement in said first direction and an angular displacement in said second direction.

68. The method as claimed in claim 67, wherein the adjusting comprises: adjusting at least one of said first magnitude and said angular displacement in said first direction if said tool face angle of said steerable drilling motor differs from said target tool face angle in said second direction; and, adjusting at least one of said second magnitude and said angular displacement in said second direction if said tool face angle of said steerable drilling motor differs from said target tool face angle in said first direction.

* * * * *